US006368000B1

(12) United States Patent
Park et al.

(10) Patent No.: US 6,368,000 B1
(45) Date of Patent: Apr. 9, 2002

(54) WRITING INSTRUMENT AND METHOD OF MAKING SAME

(75) Inventors: Edward Hosung Park, Sharon; Philip J. Sweeney, Taunton; William R. Brown, Jr., Peabody; Jean L. Spencer, Boston, all of MA (US); John M. Fritz, Verona, WI (US)

(73) Assignee: Berol Corporation, Freeport, IL (US)

( * ) Notice: Subject to any disclaimer, the term of this patent is extended or adjusted under 35 U.S.C. 154(b) by 0 days.

(21) Appl. No.: 09/576,012

(22) Filed: May 23, 2000

(51) Int. Cl.[7] ..... A46B 5/02
(52) U.S. Cl. ..... 401/6; 264/45.5; 264/46.1
(58) Field of Search ..... 401/6, 222; 264/45.5, 264/45.9, 45.6, 46.1, 173.16, 173.18; 425/113, 817 C

(56) References Cited

U.S. PATENT DOCUMENTS

| | | | | |
|---|---|---|---|---|
| 2,994,327 A | | 8/1961 | Otto et al. | |
| 3,126,139 A | | 3/1964 | Schechter | |
| 3,262,625 A | | 7/1966 | Russell et al. | |
| 3,300,551 A | | 1/1967 | Shelby | |
| 3,606,635 A | * | 9/1971 | Benteler et al. | 264/46.1 |
| 3,619,438 A | | 11/1971 | Cistone | |
| 3,904,720 A | | 9/1975 | Sjostrand | |
| 4,146,562 A | * | 3/1979 | Fukushima et al. | 264/45.5 |
| 4,397,797 A | | 8/1983 | Nojiri et al. | |
| 5,653,923 A | | 8/1997 | Spoo et al. | |
| 5,926,901 A | | 7/1999 | Tseng et al. | |
| 5,988,909 A | | 11/1999 | Luke, Jr. et al. | |
| 6,017,477 A | | 1/2000 | Lu et al. | |

* cited by examiner

*Primary Examiner*—David J. Walczak
(74) *Attorney, Agent, or Firm*—Marshall, Gerstein & Borun

(57) ABSTRACT

Writing instruments include a foam layer covering the outer surface of a preformed tubular core. The writing instruments are formed by a pultrusion process.

45 Claims, 6 Drawing Sheets

WRITING INSTRUMENT AND METHOD OF MAKING SAME

BACKGROUND

The invention relates to writing instruments having a foam layer and methods of making such instruments.

Articles that are gripped with the fingers have been provided with resilient or cushioned surfaces to improve the comfort and feel of the article to the user. In particular, writing instruments have been provided with gripping devices designed to provide a comfortable gripping area. For example, some writing instruments include a sleeve of resilient compressible material, e.g., a foam, in the gripping area of the writing instrument. The sleeve may be applied by sliding it onto the writing instrument.

SUMMARY

The invention features writing instruments that have a barrel including a foam layer covering the outer surface of a preformed tubular core. The foam layer has good resistance to skin oils and perspiration, and thus exhibits good durability over the life of the writing instrument. Preferred foam layers have desirable tactile properties and are sufficiently soft so as to provide good user comfort, while being sufficiently hard so that the user does not feel the underlying core through the foam layer.

The invention also features methods of making these writing instruments. The methods of the invention allow foamable materials that will provide these properties to be applied to a preformed core without distortion of the core. The methods of the invention also allow such foamable materials to be foamed in a controlled manner that will result in a foam layer having a desired texture and cell size distribution.

In one aspect, the invention features a method of making an elongated tubular article. The method includes passing a tubular core comprising a first material through a die having an exit, introducing a second material into the die, and foaming the second material at the exit of the die, to form the tubular article having a foam layer surrounding the tubular core. The foam layer has a substantially uniform cell size distribution in the radial direction.

The method can further include extruding a polymeric material to form the tubular core, and/or passing the tubular article through a radially adjustable end piece that is constructed to distribute the foam layer uniformly around the circumference of the tubular core.

In another aspect, the invention features a method of making a barrel for a writing instrument. The method includes passing a preformed tubular core having a first material through a die having an exit, introducing a second material into the die, foaming the second material at the exit of the die, to form a foam layer surrounding the tubular core, and cutting the tubular core and foam layer to a predetermined length, to form a writing instrument barrel having a foam gripping surface.

Embodiments of the invention can include one or more of the following features. The foam layer can be embossed and/or marked. An additive can be added to the second material, which can include a foamable, partially cross-linkable polymer comprising a blend of polypropylene and EPDM rubber. The method can further include inserting an ink refill into the barrel to form the writing instrument. The method can further include partially cross-linking the polymer during foaming.

The invention also features a method of forming a foamed layer on a preformed tubular core. The method includes drawing the preformed tubular core through a die. The die has a cavity defined between an outer member and an inner member, an inlet to the cavity, for feeding the foamable material into the cavity, and a die exit. The inner member defines a lumen through which the preformed elongate member can be drawn. The method further includes introducing a foamable material into the cavity under conditions that will cause the foamable material to foam upon exiting the die exit and form a foamed layer around the outer surface of the preformed tubular core. The inner member has an outer surface, facing the cavity, that is configured to cause substantially uniform flow of the foamable material around the inner member.

The die exit is configured to prevent foaming of the foamable material until the foamable material has exited the die. For example, the die exit can have an aspect ratio of less than one, preferably less than 0.1. The die exit can have an exit angle of about 140 to 180 degrees.

The outer surface can include a ramped diverter, which can be positioned facing the inlet. The diverter can have a teardrop shape.

Additionally, the invention features a die for extruding a foamable material onto a preformed core during pultrusion. The die includes a cavity defined between an outer member and an inner member, an inlet to the cavity, for feeding the foamable material into the cavity, and a die exit. The inner member can define a lumen through which the preformed core can be drawn, and have an outer surface, facing the cavity, that is configured to cause substantially uniform flow of the foamable material around the inner member.

Embodiments of the die can include one or more of the following features. The die can be configured to prevent foaming of the foamable material until the foamable material has exited the die. The die exit can be configured to have an aspect ratio of about one, or less than one, or approximately zero. The die exit can be configured to have an exit angle of about 140 degrees to about 180 degrees. The outer member can define the die exit.

The die can include a face plate, which can define the die exit. The face plate can be removable and replaceable.

The die can further include a diverter on the inner member constructed to provide substantially uniform flow of the foamable material around the inner member.

The inner member can include an end plate, and the diverter can have a surface angled between about 30 degrees and about 60 degrees, preferably about 45 degrees, relative to a plane perpendicular to the longitudinal axis of the lumen.

The die can also include a second diverter positioned on the inner member, for causing substantially uniform flow of the foamable material around the inner member. The second diverter, which can have a teardrop shape, can be positioned opposite the inlet.

The die can include an end piece adjacent to the die exit for uniformly distributing the foamable material around the preformed core. The end piece can have a radially adjustable ring member.

The invention further features a writing instrument having a tubular core and a foam layer on the tubular core. The foam layer includes a partially cross-linked polymer having a blend of polypropylene and EPDM rubber. The foam layer can have a substantially uniform pore size in the radial direction. The tubular core can include polypropylene.

The foam layer can have a color additive.

The foam layer can have a foam density of about 0.1 $g/cm^3$ to about 0.9 $g/cm^3$, or about 0.4 $g/cm^3$ to about 0.5 $g/cm^3$.

The foam layer can cover substantially the entire outer surface of the tubular core.

The invention also features a method of making a barrel for a writing instrument including extruding a tubular core, and applying a foam layer to the core using a pultrusion process.

Other features and advantages of the invention will be apparent from the description and drawings, and from the claims.

DETAILED DESCRIPTION

Figure 1:
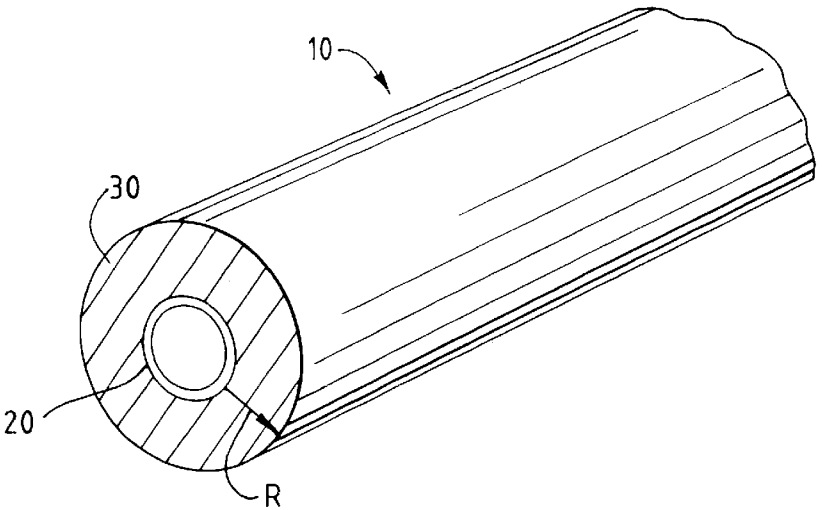
FIG. 1 is a perspective view of a foam-covered barrel according to one embodiment of the invention.

FIG. 1 shows a barrel 10 for a writing instrument that includes a tubular core 20 and a foam layer 30 surrounding core 20. Foam layer 30 provides barrel 10 with softness, texture, and a good grip. The foam is a closed cell or semi-closed cell foam to prevent dirt and oil from penetrating foam layer 30. The foam layer has good chemical resistance, for example, to hand oils and perspiration, and is sufficiently durable to withstand normal use over the expected life of the writing instrument. Foam layer 30 preferably has a foam density of about 0.05–0.95 $g/cm^3$, more preferably about 0.4–0.5 $g/cm^3$. The foam density provides a foam layer that is sufficiently soft so as to provide good user comfort, while being sufficiently hard so that the user does not feel the underlying core through the foam layer. Preferred foam layers have a hardness of from about 0 to 95 Shore A, more preferably 0 to 65 Shore A. Foam layer 30 has a substantially uniform cell size distribution in the radial direction R (FIG. 1), i.e., the cell size distribution is sufficiently uniform, from the outer surface of the core to the top surface of the foam layer. Generally, the cell size distribution is also substantially uniform in the axial direction. The cell size can be between about 1 and about 100 microns, preferably between about 30 and about 50 microns. The outer surface of the foam layer is slightly rough, to provide the user with a sense of a firm grip on the writing instrument. For example, as measured by using a profilometer, foam layer 30 may have a roughness average ($R_5$) of about 1–100 micrometers or about $0.039\times10^{-1}$–$3.9\times10^{-3}$ inches. In some cases, however, a smooth foam layer may be preferred because it may be more durable than a textured foam layer. The foam layer 30 is preferably from about 0.5 to 5 mm thick, more preferably about 1 to 2 mm. The thickness of the foam layer is preferably substantially uniform, e.g., within ±0.1 mm, around the circumference of the core.

Suitable materials for use in core 20 include rigid and semi-rigid thermoplastics, e.g., polypropylenes such as those commercially available from Phillips Petroleum (Houston, Texas) under the tradename Marlex. Other suitable thermoplastics include polyolefins, polystyrene, polyamides, and acrylonitrile-butadiene-styrene (ABS). Preferably, these thermoplastics are compatible with foam layer 30 (e.g., they adhere well to foam layer 30); are extrudable (e.g., between about 150° C. and about 300° C.); and are rigid (e.g., having a three-point bending test stiffness greater than about 100 N/m using a support span of 102 mm). The stiffness was determined by a modified ASTM D 790 test procedure in which a specimen was placed on two supports and a load was applied midway between the supports at a rate of 12.7 mm/min. The radii of the loading nose and supports were 3.2 mm (Catalog Nos. 2810-020 and 2810-032, Instron Corporation, Canton, Ma.). From a plot of force versus deflection, the stiffness was determined from the slope of the linear region of the curve.

Suitable foamable materials for use in foam layer 30 include polymers that will foam when exposed to a sudden pressure drop at the exit of the pultrusion die that is discussed below. Preferably, the foamable material includes a built-in foaming agent. Preferred polymers have a hardness of from 0–95 Shore A, more preferably 0–65 Shore A, before foaming. Preferably, foaming reduces the density of the polymer by 5 to 95%, more preferably by 30–50%. Suitable foamable materials for use in foam layer 30 include but are not limited to thermoplastic elastomers (TPEs).

A preferred foamable polymer is a partially cross-linkable polyolefin-based TPE having a built-in foaming agent that degrades upon heating to form water. An example of such a polymer is a blend of polypropylene and ethylene propylene diene monomer (EPDM) that is commercially available under the tradename SARLINK Series 4000-8100, e.g., SARLINK A8162, from DSM Thermoplastic Elastomers, Inc. (Leominster, Mass.). These polymers partially cross-link in the presence of water to form a three-dimensional network structure, and thus partial cross-linking occurs at the same time that the foaming agent degrades to form water. The network structure provides a good framework for cell formation that can enhance the chemical resistance and durability of the foamed polymer. However, the occurrence of cross-linking during foaming can make it more difficult to obtain a foam having desired properties. Thus, it is generally important that the process parameters during introduction of the polymer to the die and foaming of the polymer be carefully controlled. For example, it is important that degradation of the foaming agent occurs at the correct stage of the process, and that foaming not occur until the polymer exits the die. Moreover, these polymers tend to be difficult to coextrude with a tubular core because the high foaming pressures that are typically generated may distort the core, and thus it is preferred that they be applied to the core using a pultrusion process, as discussed below.

Foam layer 30 may also include one or more additives. For example, foam layer 30 can include particle fillers to enhance the rigidity of foam layer 30 and/or to provide foam layer 30 with roughness. Preferred fillers include particles of kaolin, calcium carbonate, zinc oxide, silica, PTFE, or blends of these particles that are compatible. If desired, one or more additives may be absorbed or adsorbed on the surface of the abrasive particles, e.g., by drum drying, spray drying, fluidized bed processing, or other suitable methods as is known in the art. Foam layer 30 can include fiber fillers to enhance strength and durability. Examples of fiber fillers include natural or synthetic fibers such as cotton, polyester, polyamides, and rayon. Foam layer 30 can also include a fragrance and/or a color concentrate.

Figure 2:
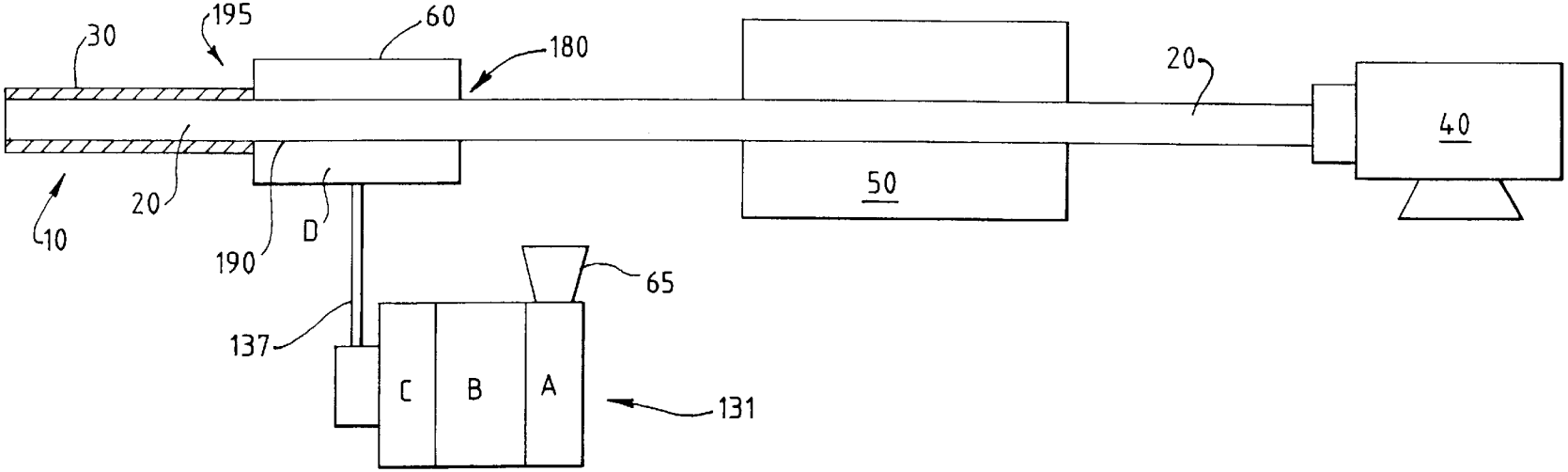
FIG. 2 is a schematic diagram of a process for making a foam-covered barrel according to an embodiment of the invention.
Figure 3:
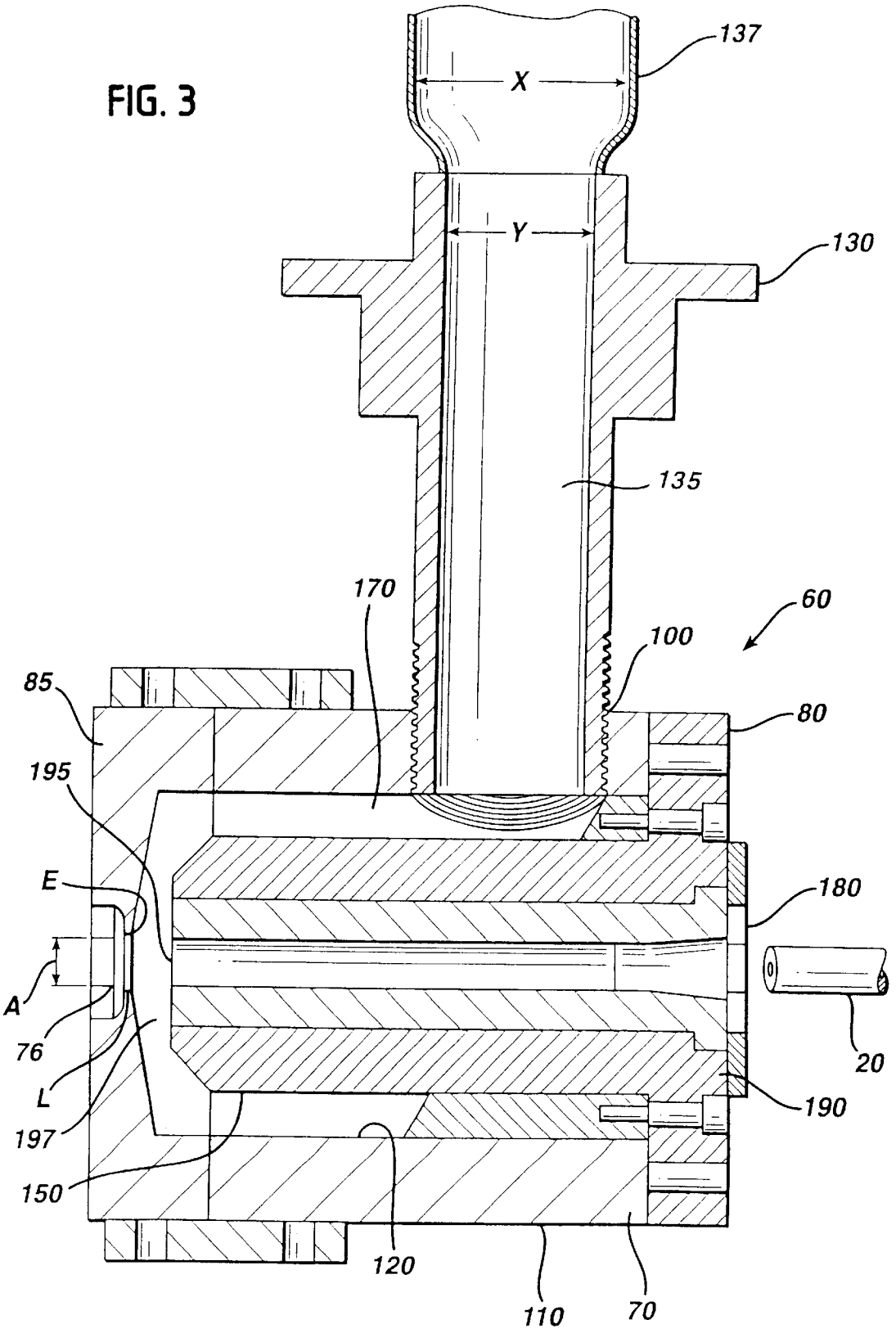
FIG. 3 is a cross-sectional view of a pultrusion device according to an embodiment of the invention.

Referring to FIGS. 2 and 3, barrel 10 is made by a pultrusion process. First, a tubular core 20, e.g., a polypropylene tube, is formed in extruder 40. Core 20 is then passed through a vacuum sizer 50 to cool the core and to ensure that core 20 is true and uniform. Extrusion processes for forming hollow elongated articles from molten thermoplastic material are well known in the art. The solidified core 20 is then passed into a die entrance 180 and through a lumen 190 defined by a pultrusion die 60. As shown in FIG. 3, pultrusion die 60 defines a cavity 170 that contains a foamable material (e.g., SARLINK A8162) that is fed into the cavity 170 through inlet 100, from an adapter 130 that receives material from a hopper 65.

Between hopper 65 and adapter 130, the foamable material passes through a heating chamber, having three distinct heating zones (zones A, B, and C, FIG. 2). The foamable material is preheated to about 160–190° C. in zone A. As the foamable material travels from hopper 65 to inlet 100, the material is heated to about 200–290° C. in zone B to degrade the foaming agent (thus forming free water), and cooled to about 160–190° C. in zone C to minimize premature foaming. When the foamable material reaches die 60, the temperature of the material is controlled to optimize the foam density and the texture of foam layer 30. Preferably, the temperature of the foamable material in the die zone D is about 140–190° C., and more preferably, about 150° C. If the temperature of the material in the die is too high, foam layer 30 may have a poor structure and a rough texture; if the temperature is too low, foam layer 30 may be overly hard, with poor foam density and an overly smooth surface. By controlling the processing temperature, the manufacturer can obtain a foam layer 30 having desired tactile properties.

Figure 4:
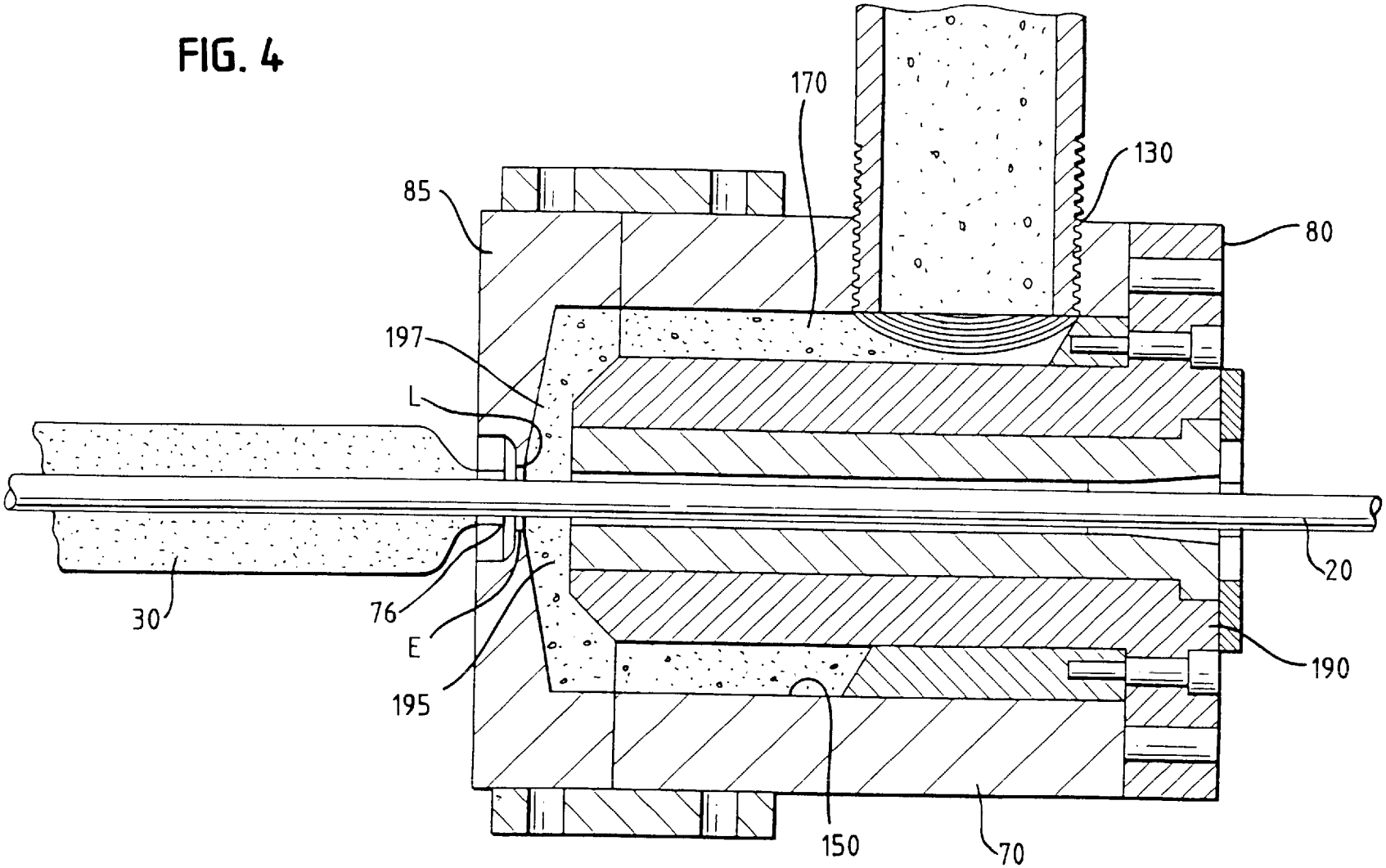
FIG. 4 is a schematic diagram of a process for making a foam-covered barrel according to an embodiment of the invention.

The foamable material within the cavity 170 is under pressure. As core 20 passes out of the lumen 190 through exit 195, the foamable material exits the die at die exit 76 (FIG. 4) and, as a result of the sudden pressure drop and the presence of water in the polymer, foams to form a foam layer 30 surrounding core 20. (Core 20 is coated with foamable material when it passes between exit 195 and exit 76, as shown in FIG. 4.) Core 20 and foam layer 30 may then pass through an optional end piece 210, as will be discussed further below, to ensure that the coating thickness is uniform around the circumference of the core. The core and foam layer are then cut to a predetermined length to form a plurality of writing instrument barrels 10. Each barrel 10 can be further modified, before or after cutting. For example, barrel 10 can be marked by painting, printing, labeling, embossing or stamping (e.g., with a heated clam shell die). The barrels are then subjected to further processing steps, e.g., the insertion of an ink cartridge, to form a finished writing instrument.

Figure 5:
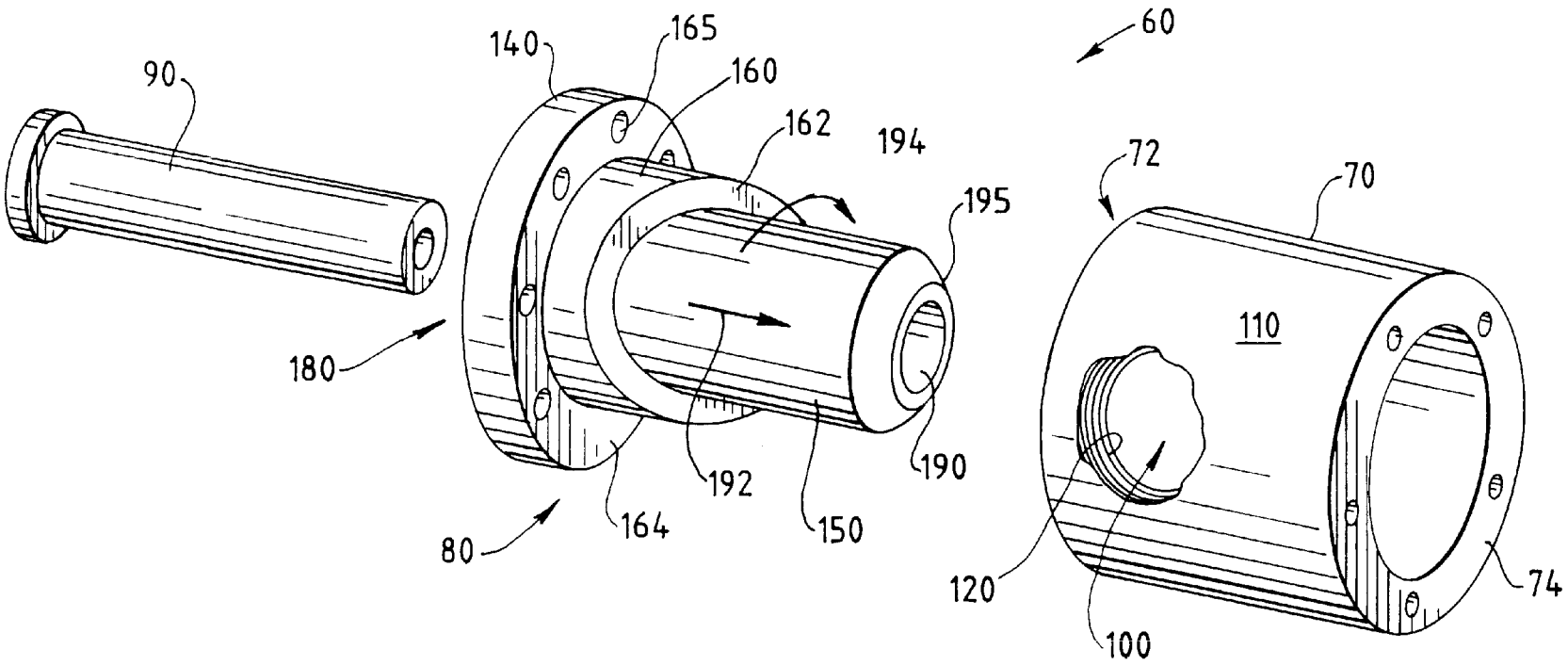
FIG. 5 is an exploded perspective view of a pultrusion die used in the device of FIG. 3.

FIGS. 3 and 5 show a pultrusion die 60 that is suitable for use in the pultrusion process described above. Pultrusion die 60 includes an outer tubular member 70, an inner tubular member 80, a face plate 85 (FIG. 3), and a plunger 90 (FIG. 5). The plunger 90 protects the lumen 190 when the die is not in use, and is removed before core 20 is passed through the lumen. The outer tubular member and inner tubular member together define the cavity 170 that receives the foamable polymer, and the inner tubular member defines the lumen 190 through which the core is passed.

Outer member 70 defines an inlet 100 for receiving the foamable polymer into cavity 170, extending from an outer surface 110 of outer member 70 to an inner surface 120 of outer member 70. Inlet 100 is configured to allow an adapter 130 to be attached to outer member 70, as shown in FIGS. 3 and 5. For example, inlet 100 can be threaded to receive adapter 130 in threaded engagement, as shown in FIG. 3.

The foamable polymer passes from heating chamber 131 to an extruder barrel 137 (FIG. 3), and then to adapter 130 and inlet 100 of die 60. Adapter 130 defines a conduit 135 configured so that as the foamable polymer flows to die 60, the foamable material experiences minimal pressure differentials, thereby minimizing foaming within the die. A preferred adapter is configured having a reduction ratio from extruder barrel 137 to adapter 130 of about 1:1 to about 10:1, preferably about 1:1 to about 2:1. The reduction ratio (X/Y) is the ratio of the diameter (X) of extruder barrel 137 to the diameter (Y) of adapter 130 (FIG. 3).

Referring to FIG. 5, inner member 80 includes an end plate 140, a cylindrical member 150 extending from end plate 140, and a ramped diverter 160 (discussed below) surrounding cylindrical member 150. Like adapter 130, inner member 80 is designed to minimize differential pressures acting on the foamable polymer to inhibit premature foaming in the die, as will be discussed further below. End plate 140 is attachable to the entrance end 72 of outer member 70, e.g., by screws through screw holes 165. End plate 140 defines a die entrance 180 through which core 20 is fed into lumen 190. Lumen 190 has a diameter slightly larger than that of core 20 and extends from die entrance 180 to an exit 195 at the opposite end of cylindrical member 150, as shown in FIGS. 3 and 4. Exit 195 is spaced from exit 76 of face plate 85, defining a chamber 197 in which the foamable polymer contacts and coats the core immediately prior to the core and polymer exiting the die at exit 76.

The geometry of die 60 is designed to meet the processing requirements of the polymer used to form foam layer 30. The preferred polymers discussed above have a tendency to foam prior to exiting the die, and thus the die geometry is configured to prevent foaming in the die by minimizing the residence time of the polymer in the die, and minimizing the pressure differentials experienced by the polymer prior to exiting the die. The preferred polymers also generally require a high-pressure drop at the exit to induce foaming. As a result, the die 60 generally has a steep exit angle E (FIGS. 3 and 4), e.g., 140–180°, and a low aspect ratio (the ratio of the die land length L to the diameter of the die exit A), e.g., less than 1, i.e., the die has a short die land length and a relatively larger exit diameter.

The die preferably includes a removable face plate 85 that defines the exit angle and aspect ratio of the die exit. Thus, at its exit end 74, outer member 70 is configured to be attached to a detachable face plate 85, e.g., by screws. Face plate 85 defines an exit 76 that has a low aspect ratio and a steep exit angle E, as described above. Preferably, the aspect ratio of exit 76 is about 1, more preferably less than 1, and most preferably, approaching zero. Preferably, exit angle E is between about 140–180°, more preferably 165–180°. Advantageously, because face plate 85 is removable, a user can easily optimize the aspect ratio and exit angle of die 60 by using differently configured face plates so that foamable materials with different foaming characteristics can be pultruded using the same die and process.

As discussed above, it is generally important, when using the preferred polymers, that the residence time of the polymer within the die be minimized to prevent premature foaming. It is also important that all of the polymer in the die experiences substantially the same residence time, i.e., that one portion of the polymer does not spend a significantly longer period of time in the die than other portions of the polymer. To this end, the die is configured to allow substantially uniform flow of the polymer from the inlet to the die exit. Uniform flow is imparted at least in part by ramped diverter 160.

Figure 6:
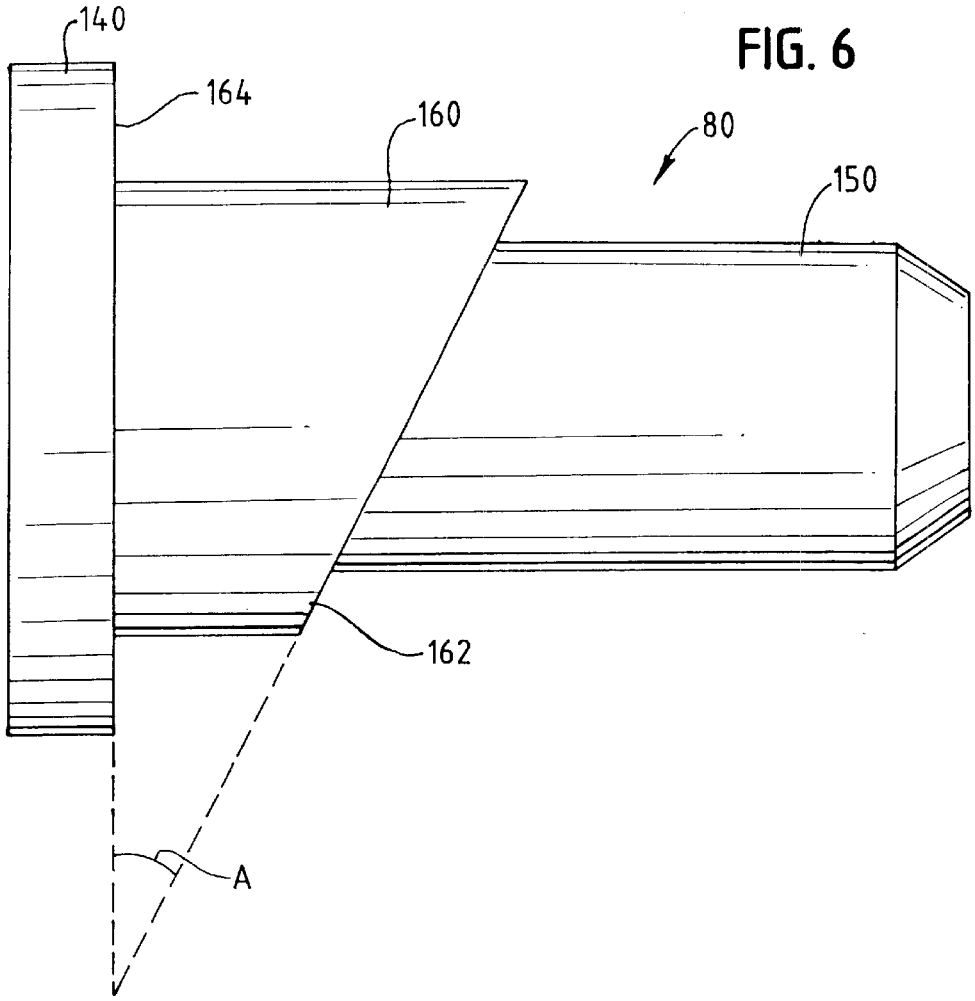
FIG. 6 is a side view of an inner member of the pultrusion device of FIG. 3.

Ramped diverter 160 extends around the circumference of cylindrical member 150 to allow foamable material to flow substantially uniformly around inner member 80 as it passes from inlet 100 to exit 76. This provides a relatively uniform residence time, as discussed above, and also allows the foamable polymer to evenly coat core 20 as the polymer flows into chamber 197. Surface 162 of diverter 160 is angled so that as foamable material fills cavity 170 and flows from inlet 100 to exit 76, the length of the flow paths, e.g., 192 and 194, of the foamable material are substantially equal all around the cylindrical member 150. That is, the distance from inlet 100 to exit 76 is substantially equal regardless of the flow path of the foamable polymer. Preferably, surface 162 is positioned at an angle A (FIG. 6) of about 30° to about 60°, more preferably about 45°, relative to the face 164 of end plate 140.

Figure 7:
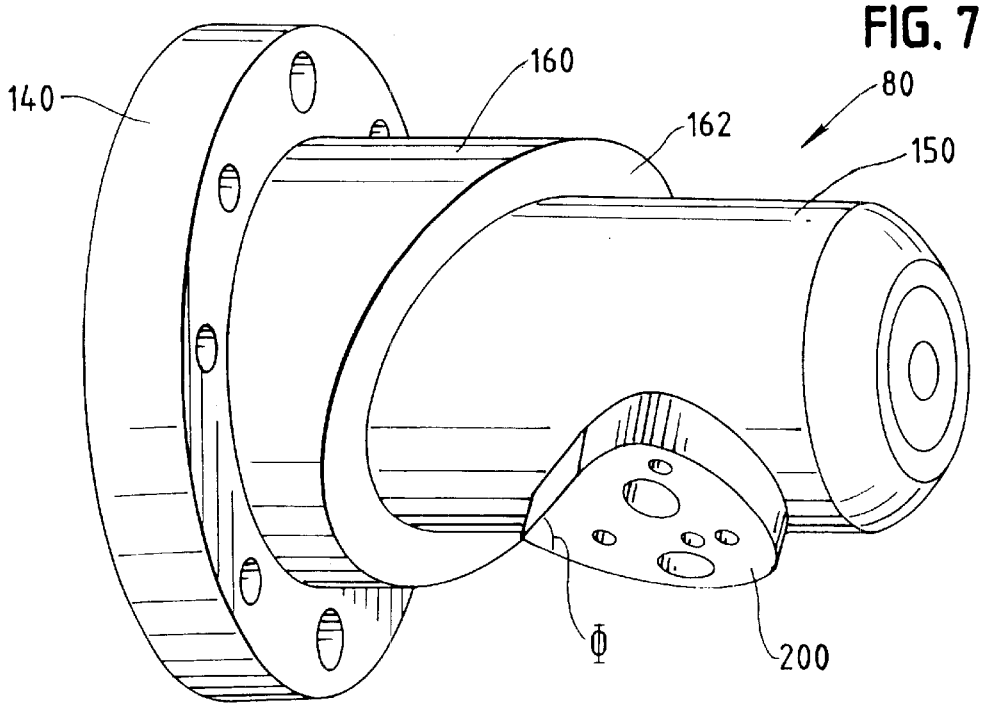
FIG. 7 is a perspective view of an inner member of the pultrusion device of FIG. 3.

Optionally, as shown in FIG. 7, inner member 80 may further include a tear-drop shaped diverter 200 that is disposed on cylindrical member 150. When inner and outer members 70 and 80 are assembled, diverter 200 is positioned to the downstream side of inlet 100, facing the incoming polymer flow. Tear-drop shaped diverter 200 further enhances the uniformity of flow of the foamable polymer around cylindrical member 150 by further equalizing the distance of the flow paths from inlet 100 to exit 76. As incoming polymer contacts the tapered end of diverter 200, the polymer is diverted from its direct path to the exit by flowing along a more extended path around the curved droplet end of diverter 200. The taper and smooth curving edges of diverter 200 minimize pressure differentials acting on the foamable polymer. Diverter 200 preferably has an angle of taper, Φ, between about 5–135°, and more preferably, between about 30–45°.

Figure 8:
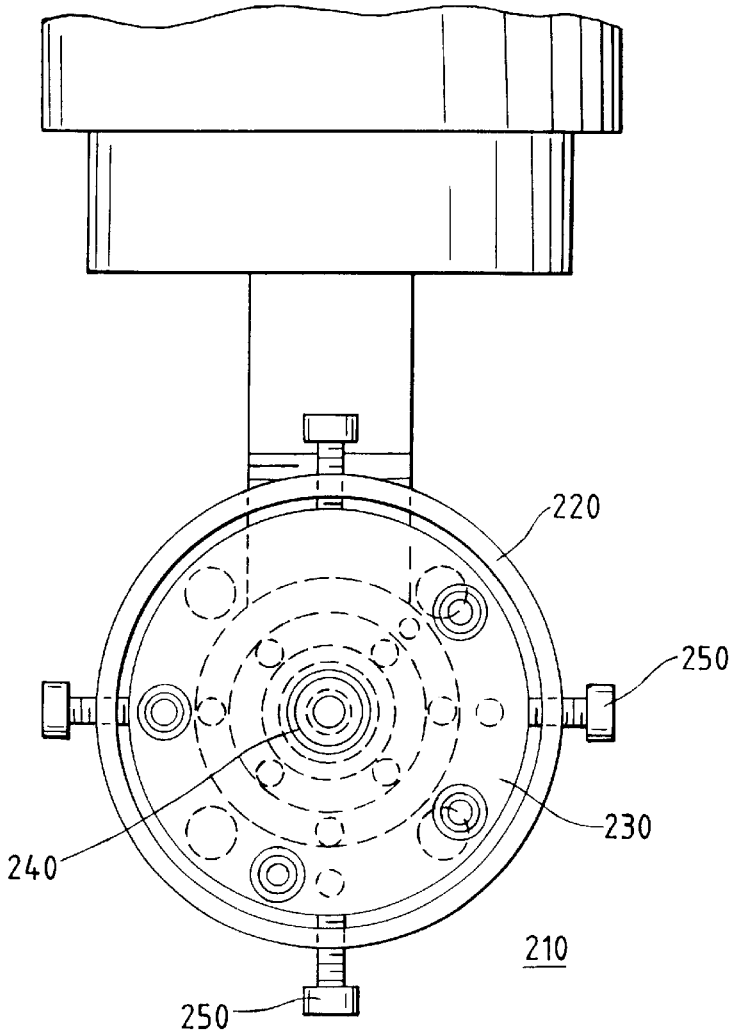
FIG. 8 is a front view of a front piece used with the pultrusion die of FIG. 3.

Optionally, as shown in FIG. 8, die 60 can include an end piece 210 positioned adjacent to exit 76. End piece 210 is provided to balance the flow of the foaming polymer so that the thickness of foam layer 30 is substantially uniform around the circumference of core 20. Generally, end piece 210 includes an outer ring member 220, and a concentric inner ring member 230, which defines a circular opening 240. End piece 210 is positioned such that circular opening 240 is generally concentric with exit 76. Circular opening 240 has a diameter slightly larger than the total outer diameter of the core 20 and foam layer 30. Typically, the clearance between the outer surface of the foam layer and the inner diameter of opening 240 is about 0.25 to 4 mm, preferably about 0.25 to 1.5 mm. Inner ring member 230 is supported within outer ring member 220 by four set screws 250. Set screws 250 allow the radial position of inner ring member 230 to be adjusted relative to outer ring member 220, and therefore, the radial position of opening 240 to be adjusted relative to exit 76. Thus, if foam layer 30 appears to be unevenly coated on core 20, set screws 250 can be adjusted to balance the thickness of the coating around the circumference of core 20.

Figure 9:
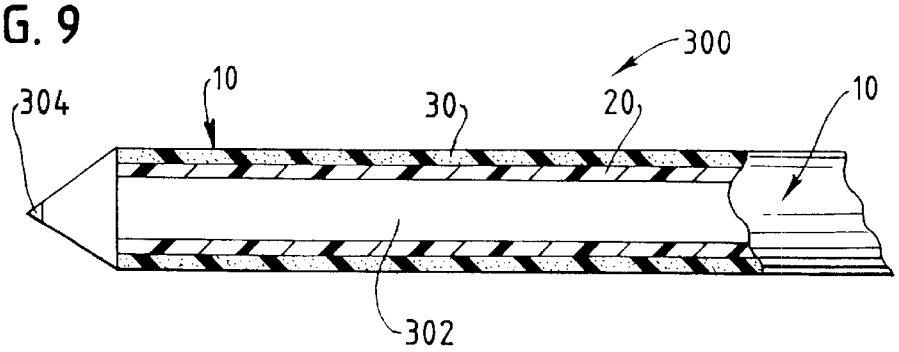
FIG. 9 is a partially cut away side view of a portion of a writing instrument constructed using the foam-covered barrel of FIG. 1.

FIG. 9 illustrates one example of a writing instrument 300 constructed using the foam-covered barrel 10 shown in FIG. 1. The instrument 300 has a writing instrument element 302, inserted into one end of the barrel 10 as shown. Element 302 is in contact with an ink reservoir within the tubular core 20. The ink reservoir can take various forms, including free ink, an ink refill, or an ink cartridge. As is generally known to those of ordinary skill in the art, the element 302 can have a writing tip 304 of virtually any form.

Other embodiments are within the claims.

For example, face plate 85 and outer member 70 can be formed as an integral member, outer member 70 can have multiple inlets 100 for introducing foamable material into cavity 170, and inner member 80 may include either, both, or neither of the diverters discussed above, depending upon the characteristics of the foamable polymer.

Additionally, the cell size distribution of the foam layer may be varied in the axial direction, i.e., along the length of the tubular core, for example to provide a writing instrument barrel having zones of foam of different properties along its length.

Moreover, foam layer 30 can also be formed of other foamable thermoplastic elastomers, such as a styrene-butadiene-styrene or styrene-ethylene-butadiene-styrene KRATON block copolymer commercially available as product Nos. G 6703, G 6713, G 2706 and D 3226 from GLS Corp. (McHenry, Ill.). Other TPEs include, for example, polyether block amides such as those available under the tradename PEBAX from Elf Atochem (Philadelphia, Pa.); polyester elastomers such as those available under the tradename HYTREL from DuPont Co. (Wilmington, De.); other styrene butadiene block copolymers such as those available under the tradename KRATON from Shell Chemical Co. (Parsippany, N.J.); styrene-propylene block copolymers, such as those commercially available from Kuraray Co. (Osaka, Japan) under the tradename SEPTON; polyurethane-based materials (TPUs), such as polymers available from Thermedics, Inc. (Woburn, Mass.), under the tradenames TECOFLEX and TECOTHANE, from Dow Chemical Co. (Midland, Mich.) under the tradename PELLETHANE, and from BASF Corp. (Mount Olive, N.J.) under the tradename ELASTOLAN; and polyolefin-based TPEs such as polymers available from DSM Thermoplastic Elastomers, Inc. (Leominster, Mass.) under the tradename SARLINK, and from Advanced Elastomer Systems (Akron, Ohio) under the tradename SANTOPRENE. Non-TPEs, such as EVA (ethylene vinyl acetate), may also be used.

The foamable material may contain other foaming agents. The foaming agent can be a physical foaming agent such as air, carbon dioxide, nitrogen, argon, and other gases. The foaming agent can also be a chemical foaming agent such as a mixture of citric acid and sodium bicarbonate, e.g., a foaming agent available under the tradename HYDROCEROL-BIH from Boehinger Ingelheim, Zupelhem, Germany. Suitable foaming agents also include compounds that will decompose at the temperatures encountered in the extruder. Other suitable chemical foaming agents include azo dicarbonamide, dinitroisopentamethylene tetraamine, sulfonyl hydrazides, p-toluene sulfonyl semicarbazide, 5-phenyltetrazole, diisoprophylhydrazo dicarboxylate, 5-phenyl-3,6-dihydro-1,3,4-oxadiazin-2-one, and sodium borohydride. Preferably from 0.1 to 5% by weight of the foaming agent is added, based on the weight of the polymer to be foamed.

Also, while it is preferred that diverter 200 have a teardrop shape, a diverter having a different shape can be positioned opposite inlet 100. For example, diverter 200 can be diamond-shaped, rectangular, elliptical, oval, round, polygonal, triangular, and semi-circular. Preferably, diverter 200 does not include sharp corners or edges since they can cause unstable or turbulent polymer flow, which can cause premature foaming of the foamable material.

What is claimed is:

1. A method of making an elongated tubular article comprising:

passing a tubular core comprising a first material through a die having an exit;

introducing a second material into the die;

foaming the second material at the exit of the die, to form the tubular article having a foam layer surrounding the tubular core, the foam layer having a substantially uniform cell size distribution in the radial direction; and inserting at least one writing instrument element into the tubular article.

2. The method of claim 1, further comprising extruding a polymeric material to form the tubular core.

3. The method of claim 1, further comprising passing the tubular article through a radially adjustable end piece that is constructed to distribute the foam layer uniformly around the circumference of the tubular core.

4. A method of making a barrel for a writing instrument, comprising:

passing a preformed tubular core comprising a first material through a die having an exit;

introducing a second material into the die;

foaming the second material at the exit of the die, to form a foam layer surrounding the tubular core; and cutting the tubular core and foam layer to a predetermined length, to form a writing instrument barrel having a foam gripping surface.

5. The method of claim 4, further comprising embossing the foam layer.

6. The method of claim 4, further comprising marking the foam layer.

7. The method of claim 4, further comprising introducing a color additive to the second material.

8. The method of claim 4, further comprising inserting an ink refill into the barrel to form the writing instrument.

9. The method of claim 4, wherein the second material comprises a foamable, partially cross-linkable polymer comprising a blend of polypropylene and EPDM rubber.

10. The method of claim 4, further comprising partially cross-linking the polymer during foaming.

11. A method of forming a foamed layer on a preformed tubular core, comprising:

drawing the preformed tubular core through a die comprising:

a cavity defined between an outer member and an inner member, an inlet to the cavity, for feeding the foamable material into the cavity, and a die exit, the inner member defining a lumen through which the preformed tubular core can be drawn; and introducing a foamable material into the cavity under conditions that will cause the foamable material to foam upon exiting the die exit and form a foamed layer around the outer surface of the preformed tubular core, the inner member having an outer surface, facing the cavity, that is configured to cause substantially uniform flow of the foamable material around the inner member.

12. The method of claim 11, wherein the die exit is configured to prevent foaming of the foamable material until the foamable material has exited the die.

13. The method of claim 12 wherein the die exit has an aspect ratio of less than one.

14. The method of claim 13 wherein the die exit has an aspect ratio of less than 0.1.

15. The method of claim 12 wherein the die exit has an exit angle of about 140 to 180 degrees.

16. The method of claim 11 wherein the outer surface of the inner member comprises a ramped diverter.

17. The method of claim 11 wherein the outer surface of the inner member comprises a diverter positioned facing the inlet.

18. The method of claim 17, wherein the diverter positioned facing the inlet has a teardrop shape.

19. A die for extruding a foamable material onto a preformed core during pultrusion, comprising:

a cavity defined between an outer member and an inner member;

an inlet to the cavity, for feeding the foamable material into the cavity; and a die exit;

the inner member defining a lumen through which the preformed core can be drawn, and having an outer surface, facing the cavity, that is configured to cause substantially uniform flow of the foamable material around the inner member.

20. The die of claim 19, wherein the die exit is configured to prevent foaming of the foamable material until the foamable material has exited the die.

21. The die of claim 19, wherein the die exit is configured to have an aspect ratio of about one.

22. The die of claim 21, wherein the aspect ratio is less than one.

23. The die of claim 22, wherein the aspect ratio approximates zero.

24. The die of claim 19, wherein the die exit is configured to have an exit angle of about 140 degrees to about 180 degrees.

25. The die of claim 19, wherein the outer member defines the die exit.

26. The die of claim 19, further comprising a face plate, the face plate defining the die exit.

27. The die of claim 26, wherein the face plate is removable and replaceable.

28. The die of claim 19, further comprising a diverter on the inner member constructed to provide substantially uniform flow of the foamable material around the inner member.

29. The die of claim 28, wherein the inner member comprises an end plate, and the diverter comprises a surface angled between about 30 degrees and about 60 degrees relative to a plane perpendicular to the longitudinal axis of the lumen.

30. The die of claim 29, wherein the surface is angled about 45 degrees relative to the end plate.

31. The die of claim 28, further comprising a second diverter positioned on the inner member, for causing substantially uniform flow of the foamable material around the inner member.

32. The die of claim 31 wherein the second diverter is positioned opposite the inlet.

33. The die of claim 32, wherein the second diverter has a teardrop shape.

34. The die of claim 19, further comprising an end piece adjacent to the die exit for uniformly distributing the foamable material around the preformed core.

35. The die of claim 34, wherein the end piece comprises a radially adjustable ring member.

36. A writing instrument manufactured according to the method of claim 11.

37. A writing instrument manufactured according to the method of claim 4.

38. A writing instrument manufactured according to the method of claim 1, wherein said foam layer comprises a partially cross-linked polymer comprising a blend of polypropylene and EPDM rubber.

39. The writing instrument of claim 38, wherein the tubular core comprises polypropylene.

40. The writing instrument of claim 38, wherein the foam layer comprises a color additive.

41. The writing instrument of claim 38, wherein the foam layer has a foam density of about 0.1 $g/cm^3$ to about 0.9 $g/cm^3$.

42. The writing instrument of claim 41, wherein the foam layer has a foam density of about 0.4 $g/cm^3$ to about 0.5 $g/cm^3$.

43. The writing instrument of claim 38, wherein the foam layer covers substantially the entire outer surface of the tubular core.

44. A method of making a writing instrument comprising:

extruding a tubular core;

applying a foam layer to the core using a pultrusion process; and inserting a writing instrument element into the tubular core.

45. A writing instrument manufactured according to the method of claim 1.

* * * * *